US005723949A

United States Patent [19]

Leupold

[11] Patent Number: 5,723,949

[45] Date of Patent: Mar. 3, 1998

[54] SPHERICAL MAGNET STRUCTURE AND USE THEREOF IN WIGGLER RADIATION SOURCE

[75] Inventor: Herbert A. Leupold, Eatontown, N.J.

[73] Assignee: The United States of America as represented by the Secretary of the Army, Washington, D.C.

[21] Appl. No.: 579,699

[22] Filed: Dec. 28, 1995

[51] Int. Cl.[6] ..... H01F 7/00

[52] U.S. Cl. ..... 315/4; 372/2; 335/306

[58] Field of Search ..... 315/4; 372/2, 37; 335/302, 306

[56] References Cited

U.S. PATENT DOCUMENTS

| | | | |
|---|---|---|---|
| H1615 | 12/1996 | Leupold | 335/296 X |
| 4,727,551 | 2/1988 | Scharlemann | 372/2 |
| 4,837,542 | 6/1989 | Leupold | 335/306 |
| 5,461,354 | 10/1995 | Rosenberg et al. | 335/306 |
| 5,486,801 | 1/1996 | Leupold | 335/306 |

*Primary Examiner*—Robert Pascal
*Assistant Examiner*—Justin P. Bettendorf
*Attorney, Agent, or Firm*—Michael Zelenka; John M. O'Meara

[57] ABSTRACT

A spherical magnet structure having a cavity centrally disposed therein about an axis therethrough, is constructed to distribute a magnetic field in the cavity with the magnitude thereof varying periodically over a circular pattern in a plane passing perpendicular through the axis. Such construction is accomplished with magnet segments of melon wedge configurations which are fabricated and arranged in accordance with the periodic distribution desired for the field. A source of wiggler radiation is derived by combining that magnet structure with means for introducing charged particles into the field which directs the travel thereof around the circular pattern in a periodic path thereacross.

14 Claims, 2 Drawing Sheets

SPHERICAL MAGNET STRUCTURE AND USE THEREOF IN WIGGLER RADIATION SOURCE

GOVERNMENT OF THE INVENTION

The invention described herein may be manufactured, used, and licensed by or for the United States Government for governmental purposes without payment to me of any royalties thereon.

BACKGROUND OF THE INVENTION

The present invention relates generally to spherical magnet structures and more particularly, to such structures for use in wiggler radiation sources.

Wiggler radiation is generated by directing charged particles through a magnetic field of periodically varying magnitude. Magnet arrangements for generating such a field along a linear path, are well known. In these arrangements, a plurality of individual magnet structures are disposed along the path on both sides thereof, to provide counter fields in opposite directions thereacross. Although such arrangements can be utilized to derive wiggler radiation, the counter fields thereof severely reduce magnetic efficiency. Otherwise, the charged particles that emit the wiggler radiation can travel the linear path of such magnet arrangements only once, which is also inefficient.

SUMMARY OFT HE INVENTION

It is the general object of the present invention to provide a spherical magnet structure having a cavity disposed therein through which a magnetic field of periodically varying magnitude is sustained over a circular pattern.

It is a specific object of the present invention to incorporate the magnet structure of the general object into a wiggler radiation source.

These and other objects are accomplished in accordance with the present invention by arranging magnet segments of melon wedge configuration to construct a spherical magnet structure. A cavity is centrally disposed in the magnet structure and each magnet segment sustains a magnetic field contribution therein. For one preferred embodiment of the magnet structure, adjacent magnet segments are separated by nonmagnetic spacings therebetween, while adjacent magnet segments are interfacing in another preferred embodiment of the magnet structure. To construct the wiggler radiation source, charged particles are directed into the cavity and influenced by the field therein to travel about the circular field pattern, while periodically traversing thereacross.

The scope of the present invention is only limited by the appended claims for which support is predicated on the preferred embodiments hereinafter set forth in the following description and related drawings wherein like reference characters relate to like parts throughout the figures thereof.

DESCRIPTION OF THE PREFERRED EMBODIMENTS

Figure 1:
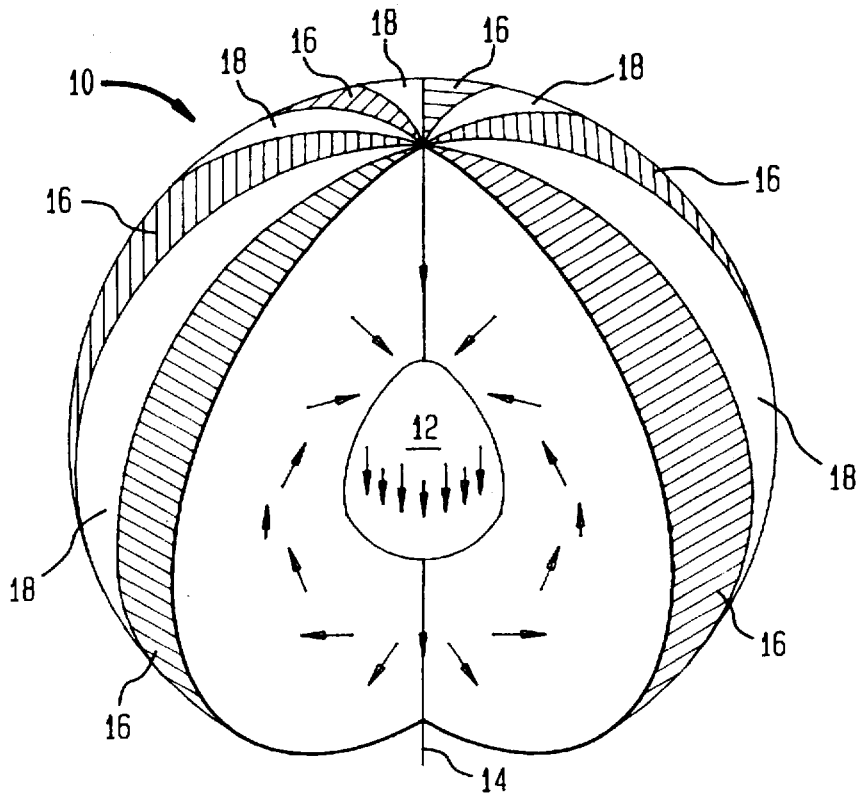
FIG. 1 is a cutaway, isometric view regarding a first magnet structure in accordance with the invention.
Figure 3:
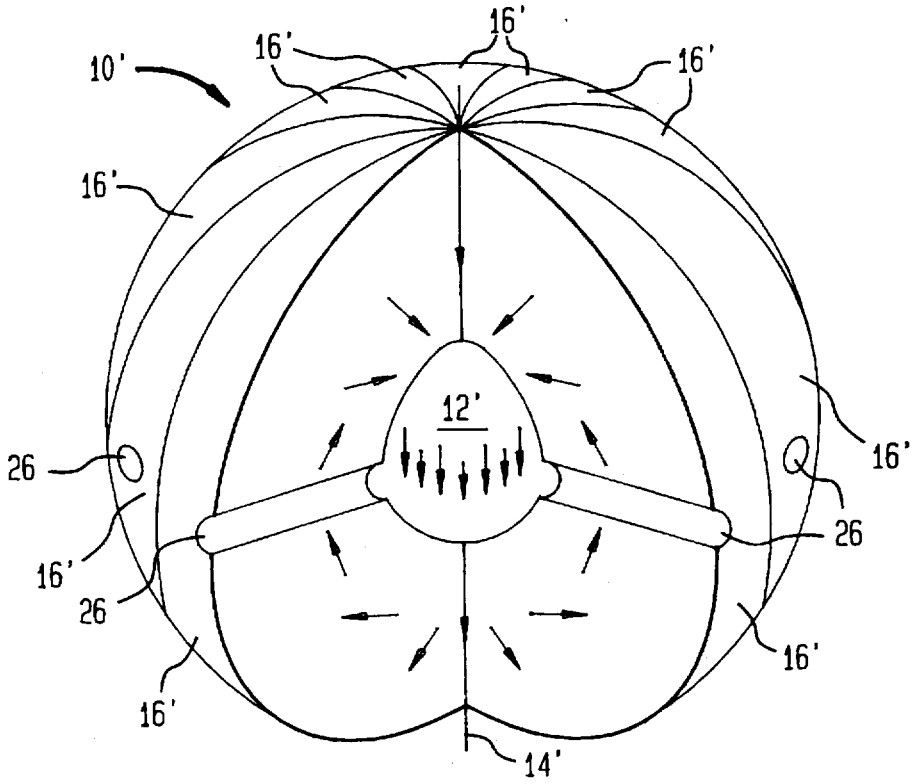
FIG. 3 is a cutaway, isometric view regarding a second magnet structure in accordance with the invention.

Of fundamental importance to the present invention is a magnet structure 10 of spherical configuration, regarding which embodiments are shown in FIGS. 1 and 3. A cavity 12 is centrally disposed within magnet structure 10 about an axis 14 which passes therethrough parallel to a magnetic field that is sustained therein, as represented by vector arrows in a direction parallel to the axis 14. A peripheral passage means for access to and egress from the cavity 12 is disposed equatorially about the magnet structure 10. Magnet structure 10 is constructed from a plurality of magnet segments 16 which are each configured like a cantaloupe melon wedge having the seeds removed therefrom. The segments 16 may have nonmagnetic spacings 18 disposed therebetween as shown in FIG. 1, or be interfacing as shown in FIG. 3. Each segment 16 is fabricated of permanently magnetic material and magnetized in accordance with the relative disposition of the segments 16 adjacent thereto. The magnetization vector in each segment 16 turns through 360° as shown in FIGS. 1 and 3, so that a magnetic field contribution is derived therefrom. As a group, the segments 16 distribute the field so that the magnitude thereof varies periodically over a circular pattern in a plane passing perpendicularly through the axis 14. The segments 16 are secured in the magnet structure 10 such as with suitable adhesive, for example epoxy.

In the FIG. 1 embodiment of the magnet structure 10, the periodically varying field magnitude is derived by fabricating adjacent magnet segments 16 so that field contributions of the same magnitude are sustained thereby in cavity 12. These contributions are represented by the longer arrows, while the possibility of magnetic field contributions which appear to result from the nonmagnetic spacings 18 are represented by the shorter arrows. However, the nonmagnetic spacings 18 can sustain no field contributions and therefore, those contributions represented by the shorter arrows must result from the segments 16, such as due to flux leakage. Embodiments having nonmagnetic spacings 18 wherein adjacent segments 16 sustain field contributions of different magnitudes, are also possible. Various approaches are possible for controlling the magnitude of each field contribution, such as by selecting the magnetic material of the segments 16 relating thereto and/or the wedge taper thereof. Great structural versatility exists relative to the nonmagnetic spacings 18. While these spacings 18 must be sufficiently unobstructed to provide the passage means for access into and egress from the cavity 12, any suitable material, such as epoxy, may otherwise be disposed therein for securing the segments 16 in the magnet structure 10. Except for the passage means, the configuration of such material within the nonmagnetic spacings 18 is essentially unrestricted however, it must not penetrate into the cavity 12.

Figure 2:
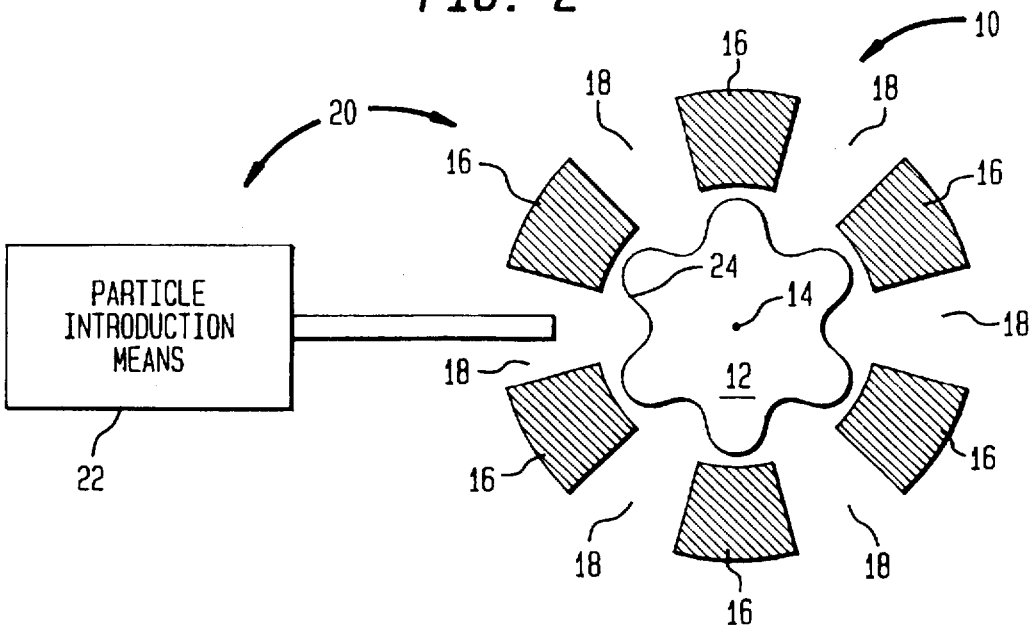
FIG. 2 is a block diagram/equatorial section view of a wiggler radiation source in accordance with the invention.

A wiggler radiation source 20 having the FIG. 1 magnet structure 10 of the invention incorporated therein, is illustrated in FIG. 2. Radiation source 20 also includes means 22 disposed in proximity to the magnet structure 10 for introducing charged particles within the cavity 12 to the plane on which the circular pattern of the periodically varying field resides. As explained above relative to the magnet structure 10 of FIG. 1, the nonmagnetic spacings 18 include the passage means in this embodiment of the radiation source 20. The charged particles introduced to the cavity 12 are influenced by the field therein to travel a continuous periodic path 24 within the circular field pattern. As will be understood by those skilled in the magnetic arts without further explanation, particle location in path 24 at anytime is determined by the centrifugal force on the particle due to its circular velocity and the centripetal force exerted thereon by the field. In FIG. 2, the traverse of the periodic path 24 within the circular pattern is exaggerated to facilitate an understanding of the invention. Consequently, wiggler radiation is generated by the charged particles and passes radially from the magnet structure 10 relative to axis 14, and through the nonmagnetic spacings 18. A conventional electron gun could serve as the particle introduction means 22 and would direct the charged particles into the cavity 12, such as through one of the nonmagnetic spacings 18.

Relative to conventional wiggler radiation sources, many advantages are realized with the wiggler radiation source 20 of the invention. All the field vectors relating to wiggler radiation source 20, are in the same direction. Consequently, the counter fields which exist in conventional wiggler radiation sources are avoided by the invention, to thereby enhance magnetic efficiency. Also, charged particles that are introduced to the field in the source 20 can repeatedly travel the periodic path 24 while migrating toward the center of the cavity 12 therein, as the velocity of those particles decreases. Those skilled in art of wiggler radiation will understand without any further explanation that the velocity and direction of such particles when introduced, as well as the location where such introduction occurs into the magnetic field, must be controlled in accordance with the magnetic and configurational parameters of the structure 10. Consequently, the direction of particle introduction shown in FIG. 2 is only one of many possibilities within the scope of the invention. As is readily apparent from FIG. 2, the frequency and traverse of the periodic path 24 relate to the number of magnet segments 16 disposed in the magnet structure 10 and the magnitudes of the field contributions sustained therein.

Another embodiment of the magnet structure 10' is illustrated by FIG. 3 wherein adjacent magnet segments 16' are interfacing. To derive the circular pattern of the periodically varying field in this embodiment, adjacent segments 16' are fabricated to sustain field contributions of different magnitudes, in the cavity 12'. These contributions are represented with alternate long and short vector arrows and could be derived using various approaches, such as by fabricating adjacent segments 16' of different magnetic materials. Relative to the axis 14', apertures 26 are radially disposed through the segments 16 to provide the peripheral passage means about the magnet structure 10' for access to and egress from the cavity 12'. As discussed above regarding the nonmagnetic spacings 18 in the wiggler radiation source 20 of FIG. 2, charged particles would be directed into the cavity 12' through one of the apertures 26 and wiggler radiation would pass radially therethrough from the cavity 12'.

Those skilled in the art will appreciate without any further explanation that within the concept of this invention, many modifications and variations are possible in the above disclosed spherical magnet structure and wiggler radiation source embodiments. Consequently, it should be understood that all such modifications and variations fall within the scope of the following claims.

What I claim is:

1. In a spherical magnet structure having a cavity centrally disposed therein about an axis passing therethrough parallel to a magnetic field which is sustained thereby in the cavity and having peripheral passage means disposed equatorially thereabout for access to and egress from the cavity, the improvement comprising:

the magnet structure is constructed from a plurality of magnet segments that each contribute to the field and as a group, distribute the field with the magnitude thereof varying periodically over a circular pattern in a plane passing perpendicularly through the axis, each segment being configured as a cantaloupe melon wedge and fabricated of permanently magnetic material in accordance with the relative disposition of adjacent segments thereto and the field contribution to be sustained thereby.

2. The magnet structure of claim 1 wherein adjacent magnet segments are separated by nonmagnetic spacings, through at least some of which the passage means is provided.

3. The magnet structure of claim 2 wherein adjacent magnet segments are fabricated to sustain magnetic field contributions of the same magnitude and direction through the cavity.

4. The magnet structure of claim 2 wherein adjacent magnet segments are fabricated of the same magnetic material.

5. The magnet structure of claim 1 wherein adjacent magnet segments are interfacing and at least some of which have apertures disposed therethrough to provide the passage means.

6. The magnet structure of claim 5 wherein adjacent segments are fabricated to sustain field contributions of different magnitudes in the same direction through the cavity.

7. The magnet structure of claim 5 wherein adjacent segments are fabricated of different magnetic materials.

8. A source of wiggler radiation, comprising:

a spherical magnet structure having a cavity centrally disposed therein about an axis passing therethrough parallel to a magnetic field which is sustained thereby in the cavity and having peripheral passage means disposed equatorially thereabout for access to and egress from the cavity, the magnet structure being constructed from a plurality of magnet segments that each contribute to the field and as a group distribute the field with the magnitude thereof varying periodically over a circular pattern in a plane passing perpendicularly through the axis, each segment being configured as a cantaloupe melon wedge and fabricated of permanently magnetic material in accordance with the relative disposition of adjacent segments thereto and the field contribution to be sustained thereby; and means for introducing charged particles to the circular pattern of the periodically varying field wherein those particles are influenced to travel around the circular pattern in a continuous periodic path which traverses thereacross and thereby generate wiggle radiation.

9. The radiation source of claim 8 wherein adjacent magnet segments are separated by nonmagnetic spacings through at least some of which the passage means is provided.

10. The radiation source of claim 9 wherein adjacent segments are fabricated to sustain field contributions of the same magnitude and direction through the cavity.

11. The radiation source of claim 9 wherein adjacent segments are fabricated of the same magnetic material.

12. The radiation source of claim 8 wherein adjacent segments are interfacing and at least some of which have apertures disposed therethrough to provide the passage means.

13. The radiation source of claim 12 wherein adjacent segments are fabricated to sustain field contributions of different magnitudes in the same direction through the cavity.

14. The radiation source of claim 12 wherein adjacent segments are fabricated of different magnetic materials.

* * * * *